US006490900B1

(12) United States Patent
Oliver et al.

(10) Patent No.: US 6,490,900 B1
(45) Date of Patent: Dec. 10, 2002

(54) PIPE GAUGING AND ROUNDING APPARATUS AND METHOD

(75) Inventors: Gene L. Oliver, Hoover, AL (US); John R. Washington, Warrior, AL (US)

(73) Assignee: American Cast Iron Pipe Company, Birmingham, AL (US)

( * ) Notice: Subject to any disclaimer, the term of this patent is extended or adjusted under 35 U.S.C. 154(b) by 23 days.

(21) Appl. No.: 09/685,887

(22) Filed: Oct. 11, 2000

(51) Int. Cl.[7] ..... B21B 3/00
(52) U.S. Cl. ..... 72/224; 72/366.2
(58) Field of Search ..... 72/77, 78, 100, 72/208, 224, 366.2

(56) References Cited

U.S. PATENT DOCUMENTS

| | | | | | |
|---|---|---|---|---|---|
| 10,569 | A | * | 2/1854 | Jackson | 72/224 |
| 1,596,751 | A | * | 8/1926 | Millspaugh | 72/78 |
| 1,607,475 | A | * | 11/1926 | Otto | 72/208 |
| 1,641,519 | A | | 9/1927 | Andre | |
| 1,736,331 | A | * | 11/1929 | Townsend | 72/702 |
| 2,041,937 | A | | 5/1936 | Korbuly | |
| 2,071,154 | A | | 2/1937 | Adams, Jr. | |
| 2,384,457 | A | * | 9/1945 | Dewey | 72/100 |
| 2,850,998 | A | | 9/1958 | Williams | |
| 3,054,438 | A | * | 9/1962 | Wegner et al. | 72/100 |
| 3,464,253 | A | | 9/1969 | Beyer et al. | |
| 3,952,570 | A | | 4/1976 | Demny et al. | |
| 4,277,967 | A | | 7/1981 | Staat et al. | |
| 4,622,841 | A | | 11/1986 | Yoshida | |
| 4,890,473 | A | | 1/1990 | Westerman et al. | |
| 5,533,370 | A | | 7/1996 | Kuroda et al. | |
| 5,607,098 | A | | 3/1997 | Kusakabe et al. | |

OTHER PUBLICATIONS

Patent Abstract of Japan, vol. 007, No. 279 (M–262), Dec. 13, 1983 & JP 58 157519 A (Daini Yoshida Kinen Tekkosho:KK:Others:01), Sep. 19, 1983 Abstract.
Patent Abstract of Japan, vol. 008, No. 005 (M–267), Jan. 11, 1984 & JP 58 168413 A (Sumitomo Kinzoku Kogyo KK), Oct. 4, 1983 Abstract.
Patent Abstract of Japan, vol. 2000, No. 13, Feb. 5, 2001 & JP 2000 271618 A (Kusakabe Denki KK), Oct. 3, 2000 Abstract.

* cited by examiner

*Primary Examiner*—Lowell A. Larson
(74) *Attorney, Agent, or Firm*—Miles & Stockbridge P.C.; John C. Kerins

(57) ABSTRACT

Apparatus and method for gauging and rounding, at room temperature, a section of fully formed seamless ductile iron pipe that has an out-of-round initial cross-section profile and/or a larger than desired initial gauge. The apparatus includes a set of hour-glass shaped gauging/rounding rolls arranged so that the combined profiles of adjacent rolls forms a substantially continuous circular of precise diameter. In operation, the ductile iron pipe is passed though the opening in the set of gauging/rounding rolls, thereby causing the pipe to be gauged and rounded. The pipe is conveyed through one or two sets of rolls to accommodate multiple pipe diameters by a transport mechanism consisting of a rail mounted push car which is moved by one or more fluid actuated cylinders anchored to a base in common with the rail.

19 Claims, 7 Drawing Sheets

PIPE GAUGING AND ROUNDING APPARATUS AND METHOD

BACKGROUND OF THE INVENTION

1. Field of the Invention

The present invention relates to a method and apparatus for gauging and rounding a section of pipe, and more specifically to gauging and rounding a section of fully formed seamless ductile iron pipe at room temperature.

2. Description of Related Art

Ductile cast iron pipe of the bell-and-spigot type includes an enlarged or bell end and an opposite end designed to be inserted into the bell end of an adjoining pipe. In the production of ductile cast iron pipe, it has been known in that art that the casting, solidification, and rapid cooling steps during the manufacturing process result in undesirable carbides and pearlite forming in the iron pipe. As a result, the pipe is normally given an annealing heat treatment to form a ferritic microstructure with graphite nodules. This microstructure has much improved properties with respect to ductility, elongation, and toughness when compared to the as-cast properties. However, the result of the heat treating process and the conversion of the microstructure results in dimensional changes in the casting. The pipe grows in diameter and length as a result of the annealing process. This growth leads to much difficulty in controlling the pipe diameter within the desired dimensional tolerances and the degree of roundness of the pipe. This is especially a problem for bell-and-spigot type pipe, which necessarily involves mating successively joined pipes. For example, 24-inch diameter cast iron pipe sections can be as much as 2 inches out of round. Larger diameter pipe sections can be 5 to 10 inches out of round. Such a degree of out-of-roundness makes such pipe sections virtually unusable in pipelines using push-on bell-and-spigot joint connections.

It has commonly been agreed or accepted in the ductile iron pipe art that, because the iron is in cast form, the material will generally not respond favorably to cold working to change its shape or dimensions. Cold working of cast iron usually results in the formation of cracks that render the cast article useless. As a result, persons skilled in the art would not generally attempt to round or gauge pipe sections that required any substantial amount of deformation, and especially not cold deformation, and prior processes and apparatus were geared toward making only minor corrections in the roundness or gauge of the pipe.

It is therefore a principal object of the present invention to provide a method and apparatus for gauging and rounding a section of fully formed centrifugally cast ductile iron pipe at room temperature from an initial out-of-round cross-section profile and initial gauge to a final, substantially circular cross-section profile and final gauge, without sustaining cracking or other failure modes.

It is a further important object of the present invention to achieve a final gauge of the ductile cast iron pipe that is smaller than the initial gauge of the pipe.

It is another important object of the present invention to achieve a substantially smoothing of the cast peen pattern on the outer dimension surface of the pipe that is suitable for uniform application of surface coatings.

It is an additional important object of the present invention to provide the above-discussed advantages in a relatively economical design.

SUMMARY OF THE INVENTION

The above and other objects of the present invention are obtained by providing an apparatus and method for gauging and rounding a section of fully formed seamless ductile iron pipe that has an out-of-round initial cross-section profile and/or a larger than desired initial gauge. This is accomplished through the use of a set of gauging/rounding rolls, each roll having an hour-glass shape, whereby the set of rolls is arranged so that the combined profiles of adjacent rolls forms a substantially continuous circle of a precise diameter. The exact diameter of the circle formed by the hourglass-shaped rolls is determined by the dimensions required for the final outside diameter of the ductile iron pipe, taking into consideration the elastic unloading of the pipe when it is removed from the apparatus.

In the specification, and especially in the claims, the term "plastically deforming" will be employed to cover the gauging and/or rounding of a pipe section. This is because there may be instances in which gauging or rounding is not actually effected, and the process is not to be limited to a process in which both are always performed and achieved.

In operation, the ductile iron pipe is passed through the circle of gauging/rounding rolls, with the pipe being at substantially room temperature, or at some elevated temperature, at the start of the process. The rounding/gauging of the pipe is accomplished through compressive yielding of the ductile iron in the hoop or tangential direction, and in the radial direction, to accommodate and conform to the dimension and roundness of the hourglass rolls.

Advantageously, in the course of performing the rounding and/or gauging, the normally heavy peen pattern on the outer surface of the pipe, imparted by the mold surface in the centrifugal casting process, is substantially smoothed by the compressive forces exerted by the rolls and the attendant yield of the material. Such heavy peen patterns are difficult to coat due to the surface roughness. Passage of the pipe through the gauging/rounding rolls reduces the height of the peens, fins, and other asperities on the pipe outer surface.

A transport mechanism for conveying the pipe through the gauging/rounding roll arrangement consists of a rail mounted push car which is moved by one or more fluid actuated cylinders anchored to a base in common with the rail. Optionally, a pair of such cars, each engaged with the pipe, operate to move the pipe into, and out of, the gauging/rounding roll arrangement.

BRIEF DESCRIPTION OF THE DRAWINGS

The above and other features of the present invention and the attendant advantages will be readily apparent to those having ordinary skill in the art, and the invention will be more easily understood from the following detailed description of the preferred embodiments taken in conjunction with the accompanying drawings, wherein like reference characters represent like parts throughout the several views.

DETAILED DESCRIPTION OF THE PREFERRED EMBODIMENTS

Figure 1:
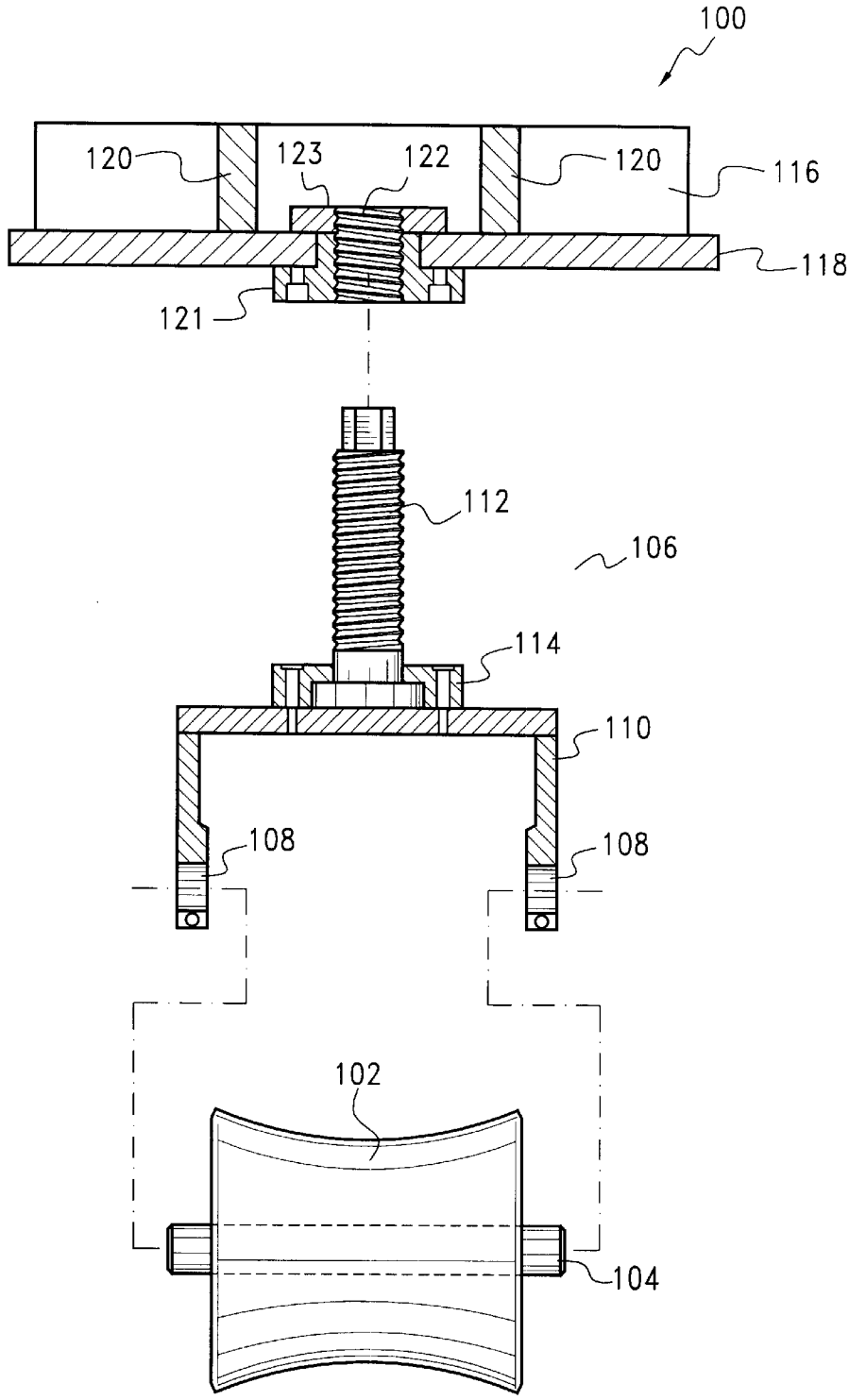
FIG. 1 is a substantially schematic illustration of an exploded view of a gauging and rounding module in accordance with a preferred embodiment of the present invention.

A gauging/rounding roll 102, axle 104, and roll housing assembly 106 of a pipe gauging and rounding module 100 according to a preferred embodiment of the present invention, are shown in exploded arrangement in FIG. 1. Roll 102 has an hourglass shape and is fitted with axle 104. Housing assembly 106 comprises a housing 110 which is preferably box-shaped (U-shaped in cross-section) and includes opposing holes 108 for receiving axle 104 between two walls of the housing in any known arrangement, so that roll 102 freely rotates with respect to housing 110. Housing assembly 106 includes housing 110, adjustment screw retainer 114 contiguous with housing 110, and adjustment screw 112, which is rotatably retained in housing 110 by adjustment screw retainer 114.

FIG. 1 also shows end plate 116, which can be of any general shape, and preferably is a flat plate that includes an adjustment screw retaining wall 118 protruding perpendicularly relative to the broad surface of the plate. Adjoining web walls 120 contiguous with, and abutting, wall 118, and contiguous with plate 116, can be provided as necessary, for added strength. Screw retaining wall 118 includes a centrally located bore 122 for receiving the adjustment screw 112. Any suitable retainer can be arranged in combination with adjustment screw 112 and retaining wall 118 such that rotation of adjustment screw 112 threadingly travels through wall 118, thereby enabling substantial load transfer between screw 112 and wall 118 to occur during operation.

Figure 2:
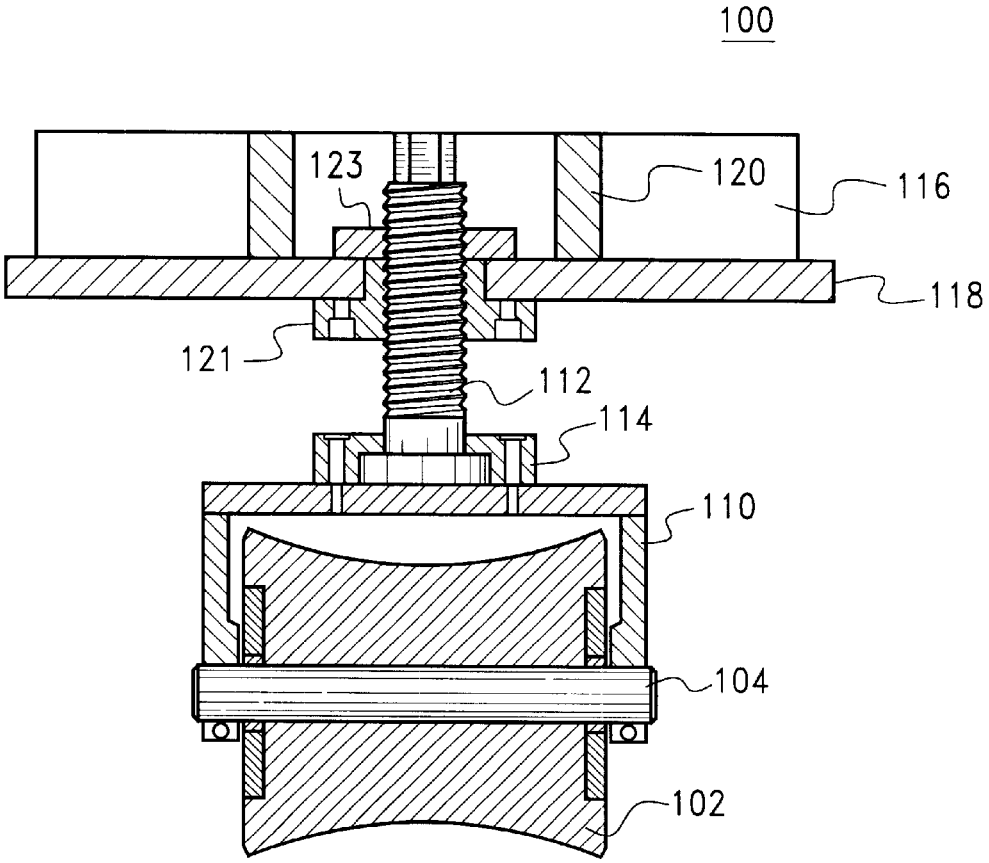
FIG. 2 is a substantially schematic sectional illustration of an assembled gauging and rounding module in accordance with a preferred embodiment of the present invention.

As can be seen in FIG. 2, screw 112 is threadingly engaged with adjusting nut 121 fitted inside bore 122 of wall 118. Advantageously, individual adjustment of each respective adjusting nut 121 provides the ability to achieve precision alignment of rolls 102. Screw 112 is secured in place with locking nut 123 once the roll is in its desired position. Because screw 112 is rotatably retained by retainer 114 attached to housing 110, rotation of adjustment screw 112 causes housing 110 to slide along the broad surface of end plate 116. The housing assembly, including roller 102, together with axle 104, as assembled in housing 110, travels linearly as an assembly when screw 112 is advanced or retracted.

Figure 3:
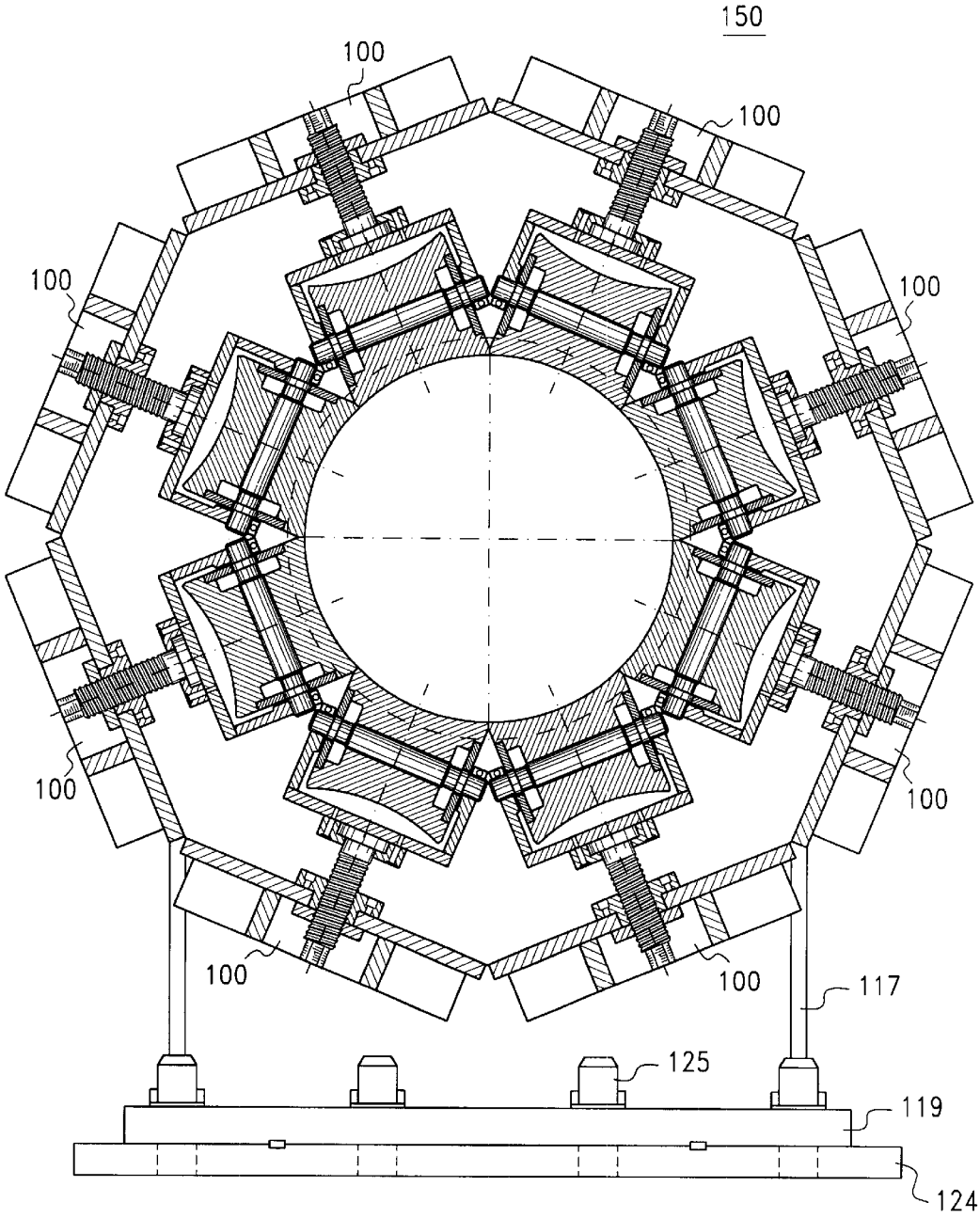
FIG. 3 is a substantially schematic sectional illustration of a gauging and rounding assembly in accordance with a preferred embodiment of the present invention showing gauging and rounding modules arranged on a frame.

FIG. 3 is a schematic illustration of a pipe gauging and rounding assembly 150 according to a preferred embodiment of the present invention, including eight modules 100 arranged so that the combined exposed profiles of rolls 102 form a continuous circle of a precise diameter. The ability to set the position of each roll independently from all others permits such a precise overall setting, and this precise positioning results in a substantially uniform compressive stress being applied to the pipe section once the pipe has been brought into round at the collective nip formed by the rolls.

Figure 4:
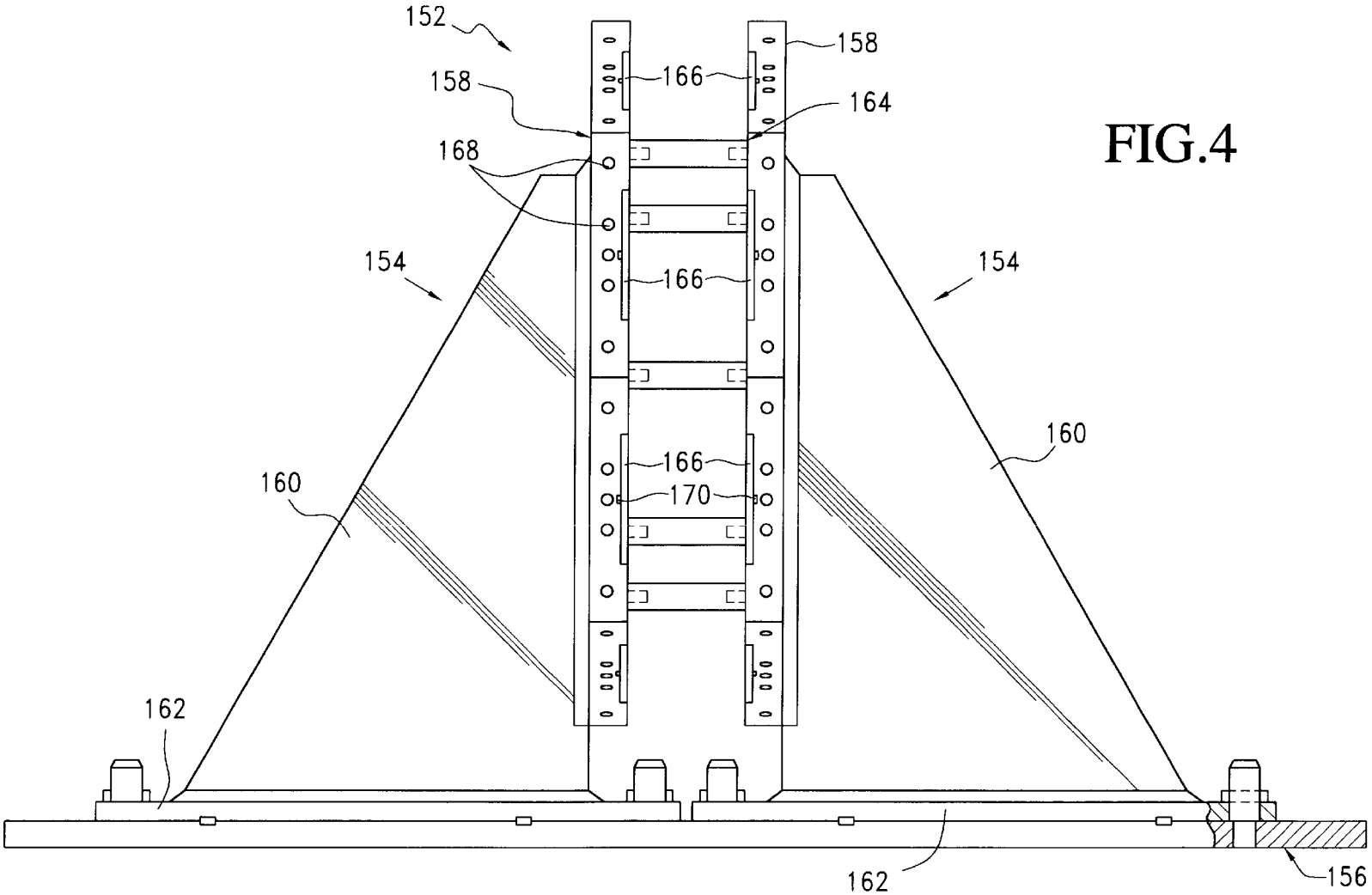
FIG. 4 is a substantially schematic side view of a pair of frame assemblies mounted on a base plate in accordance with a preferred embodiment of the present invention.
Figure 5:
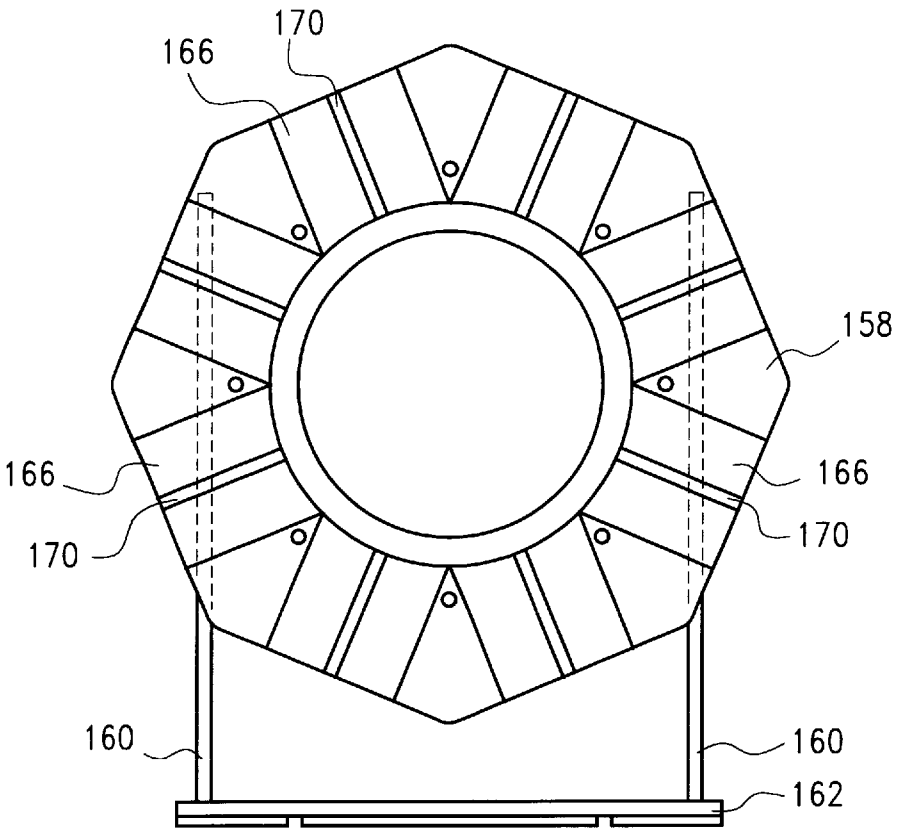
FIG. 5 is a substantially schematic illustration of a frame assembly employed in the present invention for retaining the roll modules.

An end plate 116 of each module 100 is mounted to a reinforced frame 152, the details of which are best seen in FIGS. 4 and 5. Frame 152 is preferably made up of two frame subassemblies 154 which, in operation, are mounted in facing relation (FIG. 4) to a foundation plate 156 or other highly stable mounting surface.

Each frame subassembly 154 preferably comprises an octagonal face plate 158 backed by two gusset plates 160 welded thereto, and a base plate 162 to which the gusset plates are secured, as by welding. The base plates 162 are, in turn, secured to the foundation plate 156, to position the frame subassemblies in their operating positions. A plurality of spacers 164 extending between the opposing face plates 158 are preferably used to further reinforce the overall frame 152 in this operating position.

As can be seen in viewing both FIGS. 4 and 5, each face plate 158 has a plurality of radially extending slots or channels 166 machined in the facing surface. These slots 166 are created at the regular intervals around the face plates at which the roll modules are to be positioned. The paired slots 166 (FIG. 4) present an opening into which the box-shaped housing 110 (FIG. 1) is fitted, and provide a radial guideway through which the housing 110, with its roll 102 therein, may be moved in adjusting the radial position of the roll. FIG. 4 shows, in schematic form, tapped bores 168 disposed along the outer edge of face plates 158, which are preferably used to mount the adjustment screw retaining walls 118 (FIG. 2) of the end plates 116 thereto.

Slots 166 may also preferably be provided with keyways 170 which will align with corresponding keyways (not shown) in roll housings 110, whereby keys may be employed to further aid in maintaining the housings 110 and rolls 102 in the proper, precise positions.

As will be later described in greater detail, according to the method of the present invention, a ductile iron pipe having an out-of-round, non-circular cross-section and possibly an outer diameter, i.e., a "gauge", has portions thereof that present a larger cross-section than the diameter of the circle formed by rolls 102, is advanced into the opening in the roll assembly at substantially room temperature. Uniform pressure must be exerted by the circle of hourglass-shaped rolls 102 on the outer surface of the pipe to effect a permanent change in the gauge and/or cross-sectional profile of the pipe without cracking the pipe. This is accomplished through precise circular alignment of the individual rolls 102 to collectively form a circular opening about which the rolls form a precise and substantially contiguous circular rolling surface. As a result, each desired size or gauge of pipe requires a corresponding unique set of rolls 102 that together form a circle having a radius of curvature that uniformly contacts the outer surface of the pipe, assuming the pipe to be round, and has a precise relation to the desired final gauge of the pipe. A small gap may exist between adjacent rolls in the assembly, but a more uniform pressure surface is applied to outer surface of the iron pipe if the gap is less than a quarter of an inch, and preferably, one sixteenth of an inch or less.

The exact diameter of the circle formed by the hourglass-shaped rolls 102 is determined by the dimension required for the desired final gauge of the ductile iron pipe, after taking into consideration the elastic unloading of the pipe when it is removed from gauging and rounding assembly 150. This means that the diameter of the circle formed by rolls 102 is arranged to be slightly less than the final diameter of the pipe. On the other hand, the number of rolls 102 in assembly 150 is, to a degree, arbitrary. A smaller number of larger rolls can be used, but they would be heavier and more expensive than a larger number of smaller rolls.

When it is desired or necessary to process ductile iron pipe of a different final gauge or diameter, the gauging/rounding rolls and frame assembly 150 may preferably be removed from base plate 124 as an assembly and replaced by another assembly 150 of suitable size. This allows each set of tooling to remain in critical adjustment. Alternatively, the gauging/rounding rolls could be changed out on the frame assembly, without moving the frame assembly.

Figure 6:
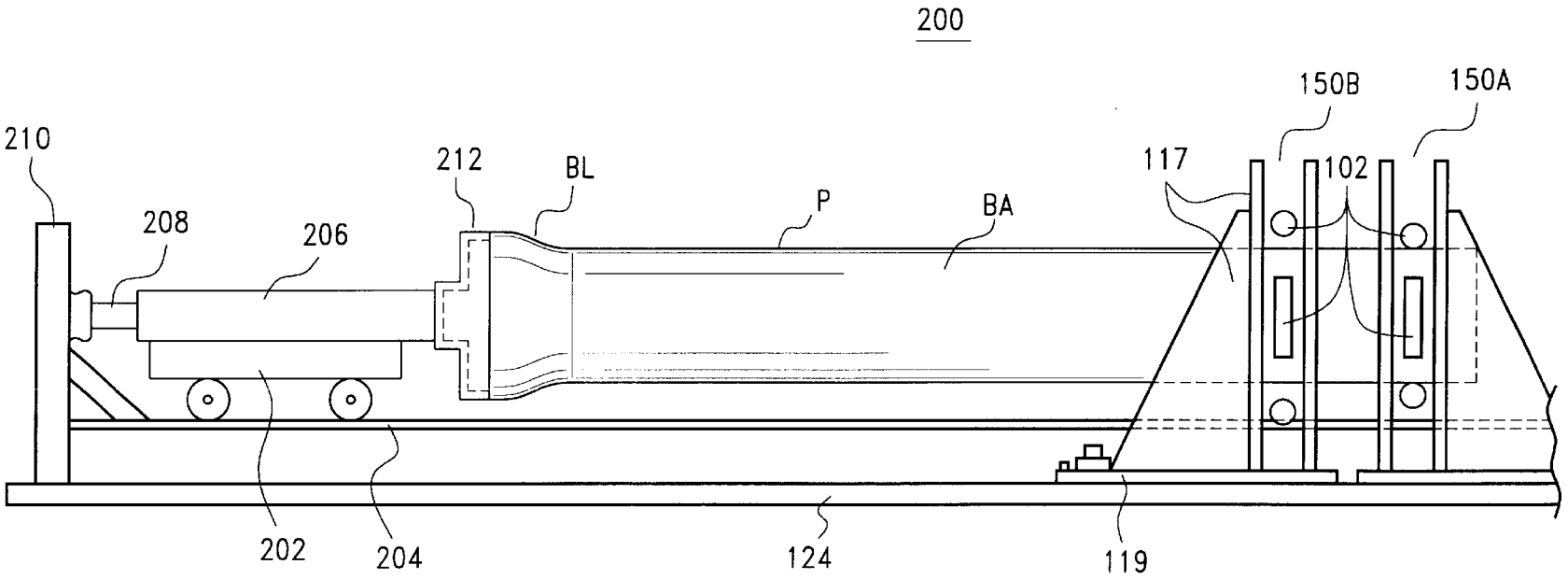
FIG. 6 is a substantially schematic sectional illustration of a transport mechanism including two gauging and rounding assemblies and a pipe to be gauged and rounded inserted therein in accordance with a preferred embodiment of the present invention.

FIG. 6 is a schematic illustration of a transport mechanism 200 according to a preferred embodiment of the present invention. Transport mechanism 200 includes an anchored base 124 to which respective frames 119 of one, or optionally two, gauging and rounding assemblies 150A,B are removably secured. Gauging and rounding assembly 150A includes a set of rolls 102 which is sized to gauge and/or round the barrel BA of a selected ductile iron pipe P to be processed. Adjacent assembly 150B is sized to gauge and/or round the bell portion BL of pipe P. Rail car 202 is configured to roll on rail 204, which can be any configuration of rails, and includes one or more rigidly mounted fluid actuated cylinders 206. Preferably, two hydraulic actuators are employed. Actuator 206 includes an exposed piston 208, which operatively presses against bulkhead 210, which is rigidly attached to base 124. The actuator end opposite exposed piston 208 includes a pushing member 212 sized and configured to engage the bell end BL of pipe P. Alternatively, the exposed piston 208 abuts pushing member 212 and the opposite end of actuator 206 abuts bulkhead 210.

In operation, pressure exerted on bulkhead 210 by piston 208 causes rail car 202 to travel along rail 204 while pushing member 212 pushes pipe P through the gauging and rounding assemblies 150A,B. Pipe barrel BA freely passes through assembly 150B and engages assembly 150A, thereby receiving tangential and radial compressive forces uniformly around its outer surface as it passes through assembly 150A. As a result of this process, barrel BA undergoes compressive yielding, and, once the pipe section barrel BA has been nearly completely advanced through assembly 150A, bell end BL comes into engagement with the rolls of assembly 150B and the bell end similarly is gauged and rounded by being passed through the nip formed by the set of hourglass rolls, and then being withdrawn from the rolls.

Pushing device 212 can be configured to grip bell BL in a manner such that, when actuator 206 is reversed, pipe P is pulled, back to its original starting position. It may also be possible, but is believed to be less advantageous, to pull the pipe section through the gauging/rounding assembly, rather than pushing, as illustrated.

In an alternative embodiment, the gauging and rounding of pipe barrel BA can be conducted separately from the gauging and rounding of bell BL.

In a preferred embodiment, two rail cars 202 with associated actuators 206 are disposed on opposite sides of gauging and rounding assemblies 150A,B. This configuration is preferable especially for the heavier, larger sizes of ductile iron pipe, so that each end is supported. With two rail cars, pressure can be successively provided at each end of the pipe so that the direction of the pipe can be reversed, as desired, either after a complete pass through the roll assembly, or intermittently, as necessary.

This process induces elastic and plastic compressive strains throughout the length of the pipe which result in a uniform gauging and substantial rounding. Advantageously, the uniform compression of the pipe effects the gauging and rounding of the pipe without causing cracking in the pipe, while the entire process is conducted at substantially room temperature. The avoidance of processing the pipe at elevated temperatures results in substantial savings in cost and processing time, and in other production efficiencies.

Another advantage provided by the apparatus and process of the present invention is that the normally heavy peen pattern on the outer surface of the pipe, which is an artifact of the molds used in the centrifugal casting process, is substantially smoothed by the compressive forces exerted by the rolls and the attendant yielding of the material. Such heavy peen patterns are difficult to coat due to the surface roughness. Passage of the pipe through the gauging/rounding rolls reduces the height of the peens, fins, and other asperities on the pipe outer surface, thereby providing a smoother surface that is conducive to receiving a coating. Typically, the surface roughness of the outer wall of the as-cast pipe is on the order of about 0.010 to about 0.025 inches, as measured by the height of the peen marks produced as a result of the peening of the deLavaud mold which is used in centrifugally casting the pipe. By subjecting the pipe section to the gauging and rounding process, the surface roughness may typically be reduced from a range of about 0.010–0.025 inches to a range of about 0.006 to 0.010 inches.

The amount of smoothing or roughness reduction depends on the amount of out-of-roundness and/or oversize of the pipe, but any degree of roughness reduction is beneficial to the subsequent coating of the pipe. The typical or average amount by which the peen mark heights are reduced is on the order of 35%, and may reach as high as 50%.

Figure 7:
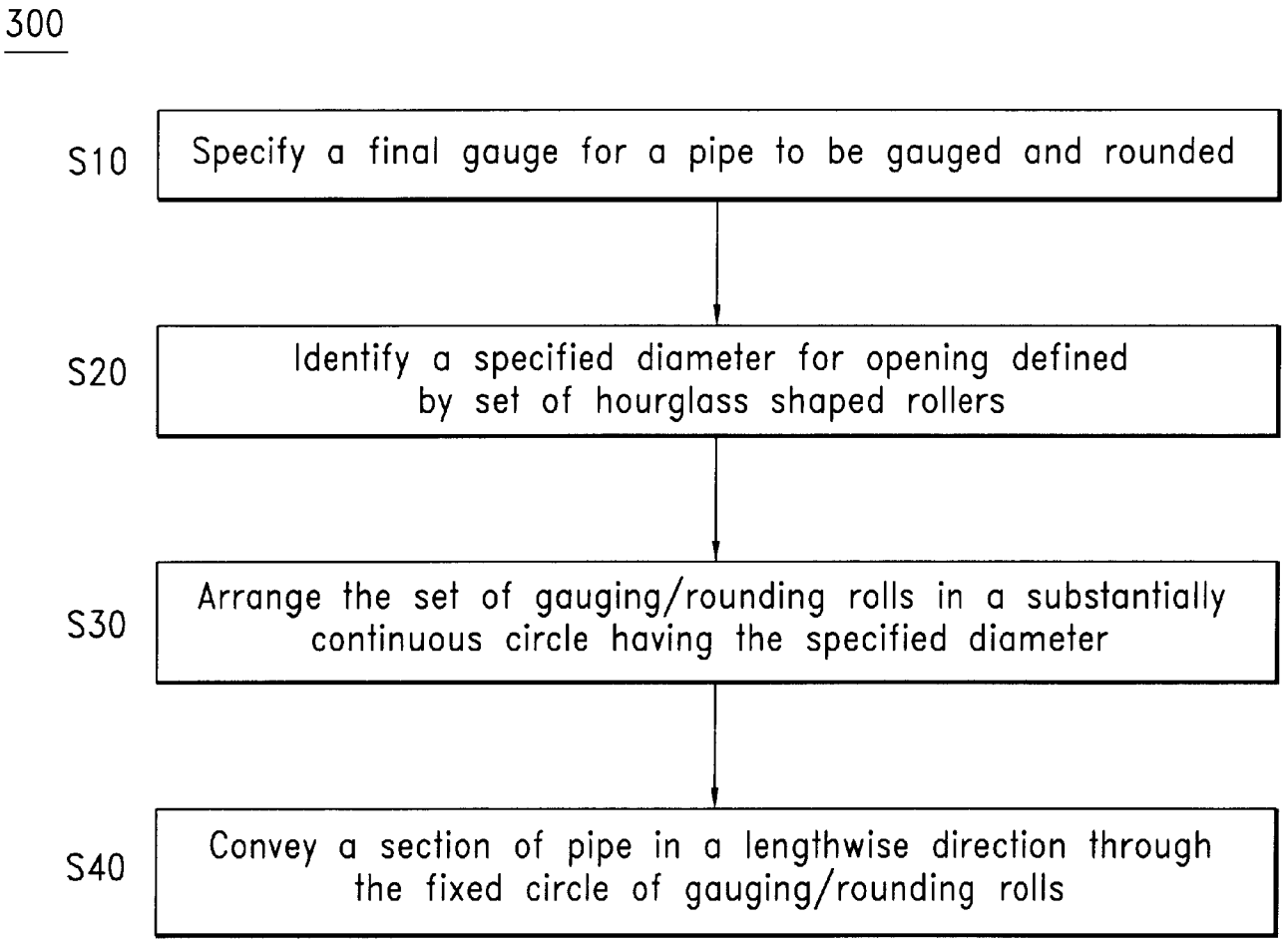
FIG. 7 is a simplified flow diagram of the preferred method of the present invention.

FIG. 7 illustrates the steps of a method 300 for gauging and rounding a section of fully formed seamless ductile iron pipe from an initial cross-section profile and initial gauge to a final substantially circular cross-section profile and final gauge, according to a preferred embodiment of the present invention. Advantageously, the pipe is processed at room temperature, and not at elevated temperatures, such as annealing temperatures typically required for use with ductile iron pipe when changing its dimensional configuration.

As shown in FIG. 7, method 300 includes step S10 for specifying a desired final gauge of a pipe to be gauged and rounded. At step S20, a specified diameter of the opening defined by the set of rolls is selected based on the final desired gauge. At step S30, a set of gauging/rounding rolls is arranged such that the exposed profile of the hourglass-shaped rolls together form a substantially continuous fixed circle defining an opening or passage therethrough of a particular size corresponding to the specified a diameter of the opening. Step S40 includes conveying a section of the pipe in a longitudinal axial direction through the set of gauging/rounding rolls so that the rolls exert a radially compressive force on the pipe, resulting in a compressive yielding of the pipe, the force being directed to reshape the pipe from an initial, potentially out-of-round, cross-section profile and initial gauge to a substantially circular cross-section profile and an intermediate gauge, whereupon, after passing through the nip of the fixed set of gauging/rounding rolls, the section of pipe elastically unloads or recovers to a slightly larger, substantially circular cross-section profile and gauge. The section of pipe is then preferably directed back through the set of rolls, whereupon the pipe again undergoes uniform compression, to the extent that the pipe diameter has increased due to elastic unloading, and, upon exiting the set of rolls, a degree of elastic unloading will again occur, resulting in the pipe section being at its final gauge.

As an example, method 300 has been used in a room temperature environment to round and gauge a 24-inch ductile iron pipe that was approximately 2 inches out-of-round. After the process was performed, the pipe section was rounded to within ⅛ inch of round, or better. The process is believed to be capable of rounding ductile iron pipe that is as much as 5 to 10 inches out-of-round, particularly with larger diameter pipe sizes. The application of method 300 to any particular size ductile cast iron pipe is essentially dependent on the diameter of the opening formed by the hourglass-shaped gauging/rounding rolls and the force used to push the out-of-round pipe into the arrangement of rolls.

It is to be noted that, in step S20 of method 300, the specified diameter of the opening formed by the exposed profile of the gauging/rounding rolls is preferably 0.2–1.0% smaller than the desired final gauge of the pipe. This is because, as noted previously, the pipe section will elastically unload after passing through the rolls, thereby increasing slightly in size. The amount of elastic unloading and dimensional change is predictable based upon data obtained through experience and/or materials properties determinations, and thus the slightly smaller opening can reliably yield a pipe diameter of a desired gauge.

The method 300 may be performed with the pipe section either at room temperature, or some elevated temperature. Room temperature processing is believed to be the most economical approach, in that no preheating of the pipe section would be required. The use of preheating or other elevated temperature processing may prove to be beneficial under certain conditions. It is further noted that, even when the method is operated at room temperature, cracks are not introduced into the ductile iron pipe because the yielding or rounding occurs in compression.

The process of the present invention can be conducted at a relatively fast speed. For example, a twenty foot length of pipe can be gauged and rounded in less than a minute. Thus, the invention provides a highly economical, accurate means by which cast ductile iron pipe can be accurately sized and rounded.

While this invention has been described in conjunction with specific embodiments thereof, it is recognized that modifications and variations will be apparent to those skilled in the art. Accordingly, the preferred embodiments of the invention as set forth herein are intended to be illustrative, and not limiting. Various changes may be made without departing from the true spirit and scope of the invention as defined in the appended claims.

What is claimed is:

1. A method of plastically deforming an elongated section of ductile iron pipe from an initial cross-section profile and initial gauge to a final substantially circular cross-section profile and final gauge, comprising the step of:

substantially uniformly radially compressing said pipe section at room temperature to cause compressive yielding of said pipe so that said pipe is deformed to said final substantially circular cross-section profile and final gauge.

2. The method as set forth in claim 1, wherein the step of radially compressing said pipe section further includes radially compressing said pipe section to an intermediate gauge that is about 0.2–1.0% smaller than said final gauge, whereupon said pipe subsequently elastically unloads to said final substantially circular cross-section profile and final gauge.

3. A method of plastically deforming a section of ductile iron pipe from an initial cross-section profile and initial gauge to a final substantially circular cross-section profile and final gauge, comprising the steps of:

arranging a set of gauging/rounding rolls in a substantially continuous circle, said circle defining an opening having a fixed specified diameter; and conveying said section of pipe in a longitudinal axial direction through said fixed set of gauging/rounding rolls so that said fixed circle of gauging/rounding rolls exerts a substantially uniform radial compressive force on said pipe, causing a compressive yielding of said pipe, to reshape said pipe from said initial cross-section profile and initial gauge to an intermediate substantially circular cross-section profile and intermediate gauge, whereupon, after further passage of said section of pipe through said fixed circle of gauging/rounding rolls said section of pipe undergoes elastic unloading.

4. The method as set forth in claim 3, wherein said pipe section is substantially at room temperature at the time that it is conveyed to the set of gauging/rounding rolls.

5. The method as set forth in claim 3, wherein said specified diameter of said opening is selected based on said final gauge of said pipe section.

6. The method as set forth in claim 3, wherein said specified diameter is about 0.2–1.0% smaller than said final gauge.

7. The method as set forth in claim 3, wherein said final gauge is smaller than said initial gauge of said pipe and larger than said specified diameter of said opening.

8. Apparatus for deforming a section of ductile iron pipe from a first initial cross-section profile and first initial gauge to a first final substantially circular cross-section profile and first final gauge, and for deforming a bell end of said section pipe from a second initial cross-section profile and second initial gauge to a second final substantially circular cross-section profile and second final gauge, comprising:

a first set of gauging/rounding rolls arranged in a first substantially continuous circle, said first circle defining an opening of a first fixed specified diameter, said first specified diameter being selected based on said first final gauge of said barrel section of said pipe, and a second set of gauging/rounding rolls arranged in a second substantially continuous circle, said second circle defining an opening of a second fixed specified diameter, said second specified diameter being selected based on said second final gauge of said bell end of said pipe, wherein said first and second sets of gauging/rounding rolls are disposed in a spaced-apart relationship along an axis of travel of said pipe section, such that conveyance of said pipe in a longitudinal axial direction through said first and second sets of gauging/rounding rolls causes said barrel section of pipe to pass through said second set of gauging /rounding rolls without contacting said rolls, and to then pass through said first set of gauging/rounding rolls to be deformed thereby, and causes said bell end of said pipe to be engaged by said second set of gauging/round rolls to be deformed thereby.

9. The apparatus as set forth in claim 8, wherein said first specified diameter is selected based on said first final gauge of said barrel section of pipe and said second specified diameter is selected based on said second final gauge of said bell end of said pipe.

10. The apparatus as set forth in claim 8, wherein said first specified diameter is about 0.2–1.0% smaller than said first final gauge and said second specified diameter is about 0.2–1.0% smaller than said second final gauge.

11. The apparatus as set forth in claim 8, wherein said gauging/rounding rolls of said first and second sets are disposed such that a gap between adjacent rolls of a set is less than one-quarter of an inch.

12. The apparatus as set forth in claim 8, further comprising:

transport means for conveying the pipe section through said first and second sets of gauging/rounding rolls.

13. The apparatus as set forth in claim 12, wherein said transport means comprises at least one rail and a rail car configured for rolling travel thereon, said rail car being configured to releasably engage said pipe and carry said pipe therewith.

14. The apparatus as set forth in claim 13, wherein said at least one rail car comprises a first rail car and a second rail car, whereby said apparatus is arranged so that said first rail car conveys the pipe into and substantially through at least one set of said gauging/rounding rolls and said second rail car conveys the pipe in an opposite direction through said at least one set of said gauging/rounding rolls.

15. The apparatus as set forth in claim 13, further comprising at least one fluid actuator, said at least one fluid actuator being mounted to move said at least one rail car with respect to said first and second sets of gauging/rounding rolls.

16. Apparatus for deforming a section of ductile iron pipe from an initial cross-sectional profile and initial gauge, to a final substantially circular cross-section and final gauge, comprising:

a frame member;

a plurality of hourglass-shaped rolls retained in roll supports, said roll supports being individually mounted to said frame member, said plurality of hourglass-shaped rolls collectively forming a circular opening of a desired diameter, wherein each of said roll supports has an independent position adjustor, for adjusting a position of each of said hourglass-shaped rolls in a radial direction; and wherein said frame member is open at its periphery at at least the areas at which the plurality of roll supports are to be mounted to receive the roll supports therein, and wherein each of said roll supports further comprises an end plate so constructed and arranged to removably mount said roll support to said frame member.

17. Apparatus as set forth in claim 16, wherein said frame member comprises a pair of parallel, spaced-apart face plates, and wherein an outer edge of each face plate provides a mounting surface for said end plates of said roll supports.

18. Apparatus as set forth in claim 17, wherein said pair of parallel face plates further include a plurality of channels formed by the inwardly facing surfaces thereof, to receive therein the plurality of roll supports.

19. Apparatus as set forth in claim 18, wherein each of said roll supports comprises a housing partially enclosing each of said hourglass-shaped rolls, and wherein each of said plurality of channels formed by said face plates is sized to closely engage each said housing.

* * * * *